US005193503A

United States Patent [19]

Bornmann et al.

[11] Patent Number: 5,193,503

[45] Date of Patent: Mar. 16, 1993

[54] LOAD ADJUSTMENT DEVICE

[75] Inventors: Gerd Bornmann, Hochheim; Egon Beil, Florstadt, both of Fed. Rep. of Germany

[73] Assignee: VDO Adolf Schindling AG, Frankfurt am Main, Fed. Rep. of Germany

[21] Appl. No.: 763,517

[22] Filed: Sep. 23, 1991

[30] Foreign Application Priority Data

Oct. 24, 1990 [DE] Fed. Rep. of Germany ..... 4033802

[51] Int. Cl.[5] ..... F02D 9/02; F02D 9/10

[52] U.S. Cl. ..... 123/339; 123/399

[58] Field of Search ..... 123/361, 399, 339

[56] References Cited

U.S. PATENT DOCUMENTS 5,014,666 5/1991 Westenberger ..... 123/399 X

FOREIGN PATENT DOCUMENTS 0154036 9/1985 European Pat. Off. .
1202571 10/1965 Fed. Rep. of Germany .
3039521 5/1982 Fed. Rep. of Germany .
3907133 3/1990 Fed. Rep. of Germany .
2216601 10/1989 United Kingdom .

*Primary Examiner*—Tony M. Argenbright
*Attorney, Agent, or Firm*—Martin A. Farber

[57] ABSTRACT

A load adjustment device has a throttle valve 9 which determines the output power of an internal combustion engine and is connected, fixed for rotation, with a throttle-valve shaft 33 mounted in the throttle-valve housing 40. The throttle valve shaft 33 has a mechanical linkage on the accelerator-pedal side, and a setting-member-like linkage side with which a setting member is operatively coupled for displacing the throttle valve 9 in idle operation. A setting member 29 is provided on its outer end with a circular-arc segment 31 which is developed as permanent magnet and cooperates with a magnet 32 which can be excited with current as desired. In this way, an electric motor and gearing can be dispensed with.

4 Claims, 2 Drawing Sheets

LOAD ADJUSTMENT DEVICE

FIELD AND BACKGROUND OF THE INVENTION

The present invention relates to a load adjustment device having a throttle valve (9) which determines the output power of an internal combustion engine and is connected, fixed for rotation, with a throttle-valve shaft (33) which is mounted in a throttle-valve housing (40), the throttle-valve shaft (33) having a mechanical linkage on the accelerator-pedal side, the shaft having a setting-motor linkage side associated with setting motor means for displacing the throttle-valve (9) in idle operation.

In such a load adjustment device, the displacement of the throttle valve into the emergency idle position is customarily effected via a spring which, for this purpose, displaces the throttle valve via a setting-element part, the displacement of the throttle valve into an open position being effected by means of a motor. In normal idling operation, a control device controls an electric motor so that the throttle valve is displaced into the desired position on the basis of values processed by the control device. If the throttle valve is in the idling range between the emergency idling position and the minimum idling position, then the electric motor operates continuously against the setting force of a spring which must be so designed that in an emergency idling situation the setting force of the spring is sufficient to overcome all frictional resistance as well as opposing moments on the throttle valve and the electric motor in order to bring them into an emergency idling position. This state of load is decisive for the dimensioning of the spring. Furthermore, an electric motor takes up substantially more installation space so that this leads to an increase in the cost of the plant.

SUMMARY OF THE INVENTION

In contradistinction to this, it is an object of the invention to develop and arrange the load adjustment device and the corresponding setting elements for displacing the throttle valve into operating position to minimize an amount of construction space.

According to the invention, in a load adjustment device of the aforementioned type, the setting member (29) has a magnet part which cooperates with a magnet (32) which can be optionally provided with current. In this way, the customary electric motor is replaced in simple manner by an optionally actuatable electromagnet which, in advantageous manner, via a setting element developed as magnet, displaces the throttle valve between an $LL_{min}$ and an $LL_{max}$ position. If the optionally actuatable magnet is disconnected, then the return spring moves the throttle valve back into its initial position, i.e. into the $LL_{min}$ position. The actuatable electromagnet can easily be arranged in the throttle valve housing in view of its small size, so that the setting member can be manufactured at substantially less expense.

Due to the direct arrangement of the setting lever on the throttle valve shaft, the customary gearing between an electric motor for the displacement of the throttle valve can be dispensed with, so that the setting member can also be produced at substantially less expense than previously.

An intermediate position of the throttle valve is obtained in simple manner by the provision on the throttle valve shaft of a potentiometer which carries out a desired-value/actual-value comparison and then controls the actuatable magnet via the control device until the desired position has been reached.

In accordance with a feature of the invention, it is provided that the setting member be developed as a setting lever (29) on the outer end of which the magnet part is connected.

Preferably, furthermore, on the outer end of the setting lever (29), there is arranged a circular-arc segment (31) which can be displaced as a function of a setting variable of a control device (17) by an opening of the actuatable magnet (32).

As a further development of the invention, it is advantageous that the setting member be firmly attached, directly or indirectly, to the throttle-valve shaft or the throttle valve and produce a displacement of the throttle valve as a function of the flow of current in the magnet. In this way, a further structural part, in particular the gearing, can be dispensed with, which leads to a further saving of expense on the part of the setting member of the invention.

In accordance with a further feature of the invention, it is finally provided that the setting member (29) is connected, directly or indirectly, to a return spring (12) which, when the magnet (32) is without current, moves the throttle valve (9) into the idling position $LL_{min}$.

It is advisable that the setting member (29) be displaceable between an idle stop $LL_{min}$ and an idle stop $LL_{max}$.

According to a feature of the invention, the circular-arc segment (3i) arranged on the setting member (29) is developed as a permanent magnet.

BRIEF DESCRIPTION OF THE DRAWING

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
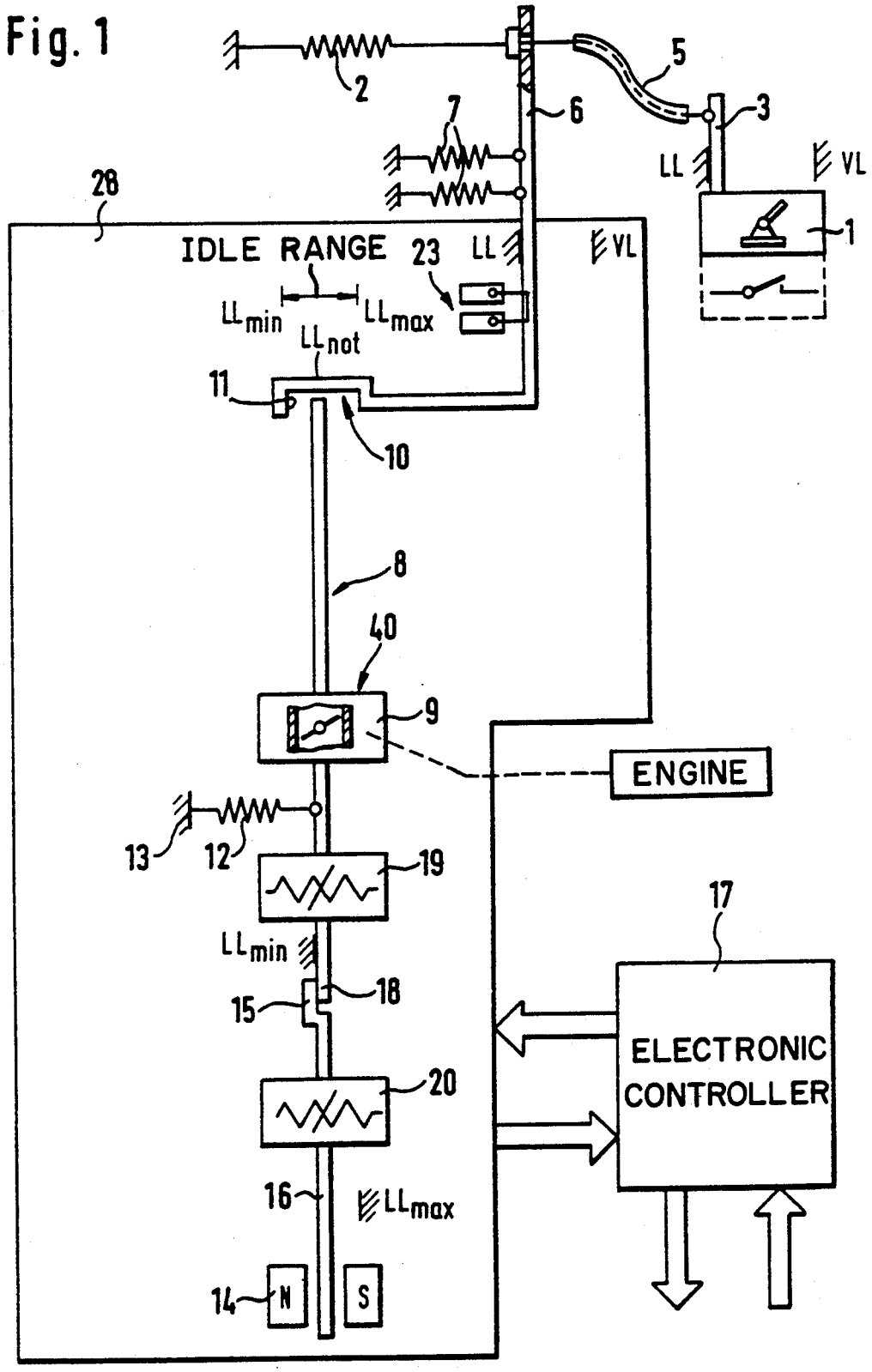
FIG. 1 is a block diagram showing the basic operation of the load adjustment device of the invention.

The parts shown within the frame 28 in FIG. 1 form a single structural unit of the load adjustment device. The load adjustment device includes a setting magnet 14 which is connected for drive with a throttle valve 9. Via the setting magnet 14, the setting forces are transmitted to the throttle valve 9 and, in this way, displacement into the desired position is brought about.

As can be noted from FIG. 1, the load adjustment device can be displaced via an accelerator pedal 1, in which connection, by actuation of the accelerator pedal 1, a lever 3 is displaced between an idle stop LL and a full-load stop VL and urged via a return spring 2 in the idling direction LL. The accelerator pedal 1 is connected by a gas (Bowden) cable 5 to a driver 6 so that upon actuation of the accelerator pedal 1 the driver 6 is displaced in the direction of the full load stop VL. Reset springs 7 are connected to the driver 6 and urge it in the idle direction LL. The reset springs are so designed that they have redundant effects on the return drive. As long as the gas cable 5 is not acted upon, the driver 6 lies against the idle stop LL associated with it.

The driver 6 cooperates directly with a first setting-element part 8 which serves for the displacement of the throttle valve 9 of an internal combustion engine, not shown in the drawing. The first setting-element part 8 is shown only diagrammatically in FIG. 1.

The end of the driver 6 facing away from the gas cable 5 is provided with a recess or free-travel region 10 into which the end of the first setting-element part 8 engages. Adjoining the recess or free-travel region 10 of the driver 6 there is a stop 11 against which the first setting element part 8 comes when the accelerator pedal 1 displaces the stop 11 out of the minimum idling position beyond the emergency idling position.

Below the recess or free-travel region 10, there is a spring 12, one end of which is connected to a stationary point 13 and the other end to the first setting-element part 8, urging the latter in the idling direction. By the fixed arrangement of the spring 12, there is obtained a direct moving back of the throttle valve 9. The spring 12 is active over the entire displacement range of the first setting-element part 8, and thus over the entire load range of the internal combustion engine. The spring 12 acts thus in the same direction as the two reset springs 7, so that, upon failure of the control device 17, the throttle valve 9 is displaced into the emergency idle position ($LL_{not}$).

Figure 2:
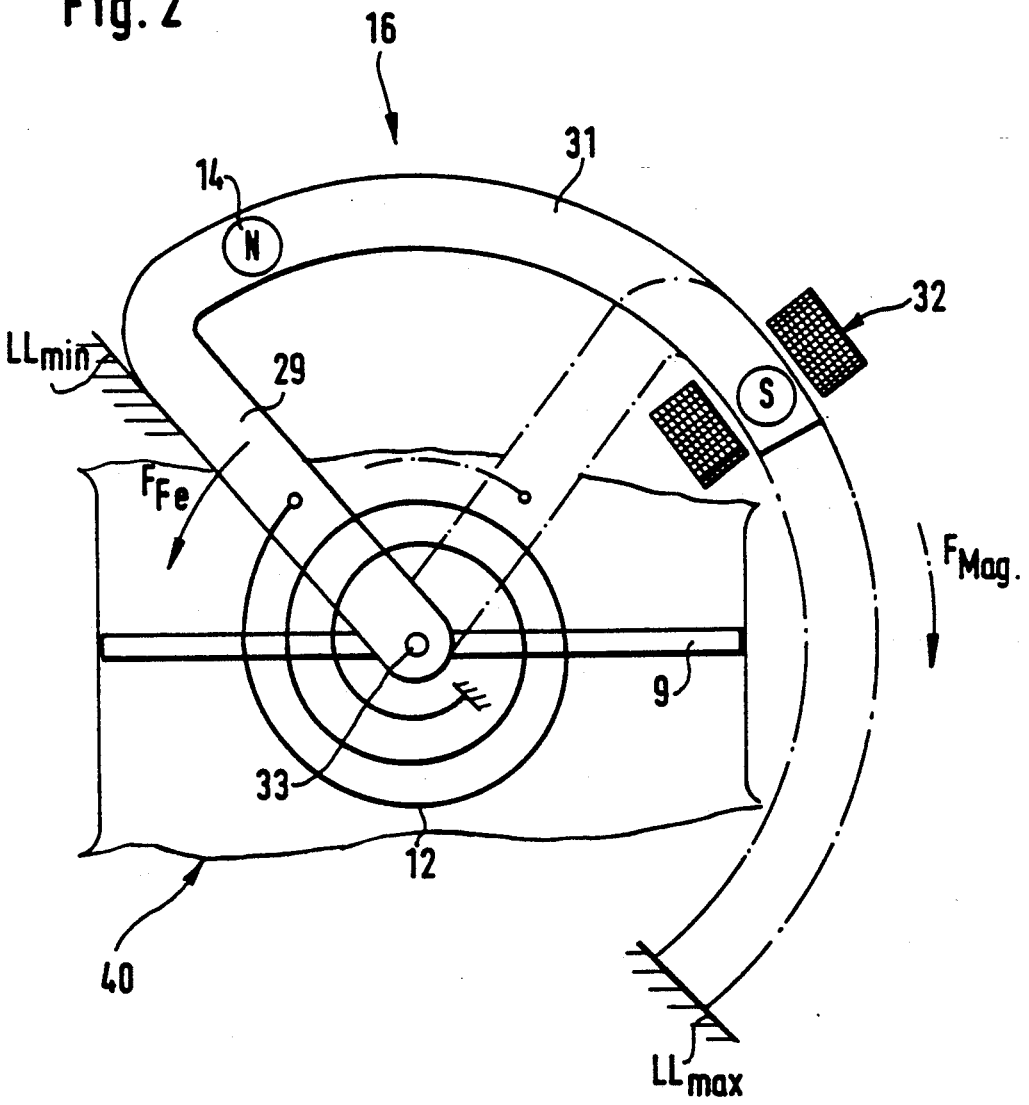
FIG. 2 shows the displacement device having a setting magnet for moving the throttle valve into an operating position.

The load adjustment device has, in addition to the first setting-element part 8, a second setting-element part 16 which is represented, in accordance with FIG. 2, by the setting magnet 14. The second setting-element part 16 is also merely diagrammatically indicated in FIG. 1. A gearing (not shown in the drawing) can be associated with it. Such a gearing, however, is not necessary. The two setting element parts 8 and 16 are not rigidly connected to each other but are coupled only in one direction of movement, namely in the upward-control direction. For this purpose, one end of the second setting-element part 16 has a driver element 15 which can come against the stop 18 provided on the first setting-element part 8 if the electronic control device 17, forming part of the load adjustment device, fails.

In FIG. 1, the electronic control device 17 which contains processing, logic and control circuits is indicated diagrammatically. In its digital part, the control device 17 stores values for adaptation to the vehicle and processes the digital or digitalized values of various input variables which then control the desired position of the throttle valve 9 via an analog part. With the electronic control device 17 there cooperates an actual-value detection device 19 belonging to the first setting-element part 8 and an actual-value detection device 20 which is associated with the second setting-element part 16 and detects the instantaneous position of the second setting-element part 16. By the electronic control device 17 furthermore signals are detected via an idle contact 23, activated by the driver 6, when the driver comes against the idle stop LL associated with it. Via the idle contact 23 the circuit to the control device 17 is interrupted when the idle control range ($LL_{min}$-$L_{max}$) is left. In the partial-load and full-load regions the setting magnet 14 is no longer controlled via the control device 17. The displacement of the throttle valve 9 then takes place only via the lever 3, the gas cable 5 and the driver 6.

The electronic control device 17 serves the purpose, in cooperation with the actual-value detection device 19, 20 and external reference variables, of developing a safety logic with respect to control of the first and the second setting-element parts 8, 16. As soon as the electronic control device 17 or the setting magnet 14 no longer operate properly, the first setting element part 8 and thus the throttle valve 9, are moved into the emergency idling position $LL_{not}$ by the spring 12 which is pretensioned in the direction of the maximum idling position together with the corresponding setting member.

As can be noted from FIG. 2, the second setting-element part 16 comprises of a setting lever 29 which advantageously can be connected directly to the throttle valve 9 or to the throttle-valve shaft 33 and to which a spring is directly or indirectly connected. The setting lever 29 is provided on its outer end with a circular-arc segment 31 which is developed as magnet (with N and S poles) and can be displaced between the idle stop $LL_{min}$ and the idle stop $LL_{max}$. The circular-arc segment 31 is displaced by a magnet 32 which is an electromagnet and can be magnetized as desired and is controlled via the control device 17.

The throttle valve 9 shown in FIG. 2 can be displaced over an angular range of 90°. If, for instance, the magnet 32 has no current, the spring 12 pulls the throttle valve 9 back against the stop $LL_{min}$. The gearing customarily present between an electric motor for the adjustment of the throttle valve 9 can be dispensed with due to the direct arrangement of the setting lever 29 on the throttle-valve shaft 33, so that the second element part setting 16 can be produced at substantially less cost than previously.

An intermediate position of the throttle valve is easily reached in the manner that there is provided on the throttle-valve shaft 33 a potentiometer or the actual-value detection element 19, 20 which enables a desired-value/actual-value comparison, and then allows control via the control device 17 and the actuatable magnet 32 until a desired position has been reached.

As is evident from the above, with normal idle control operation, the control device 17 also controls the setting magnet 14 until the throttle valve 9 is displaced into the desired position as a result of the values processed by the control device 17.

We claim:

1. A load adjustment device for an internal combustion engine comprising:

a throttle valve housing, a setting member, an electromagent, a throttle valve shaft, and a throttle valve which determines output power of an internal combustion engine, the throttle valve being connected and fixed for rotation with the throttle-valve shaft which is mounted in the throttle-valve housing; and wherein the throttle-valve shaft has a mechanical linkage on an accelerator-pedal side of the shaft, and a setting-motor linkage side operatively coupled with the setting member for displacing the throttle-valve in idle operation;

the setting member has a magnet part which cooperates with the electromagnet, the electromagnet being actuatable with current;

the setting member comprises a setting lever, and the magnet part is supported on an outer end of the setting lever; and the magnet part is formed as a circular-arc segment and is displaceable as a function of current applied to the electromagnet by the adjustment device.

2. A load adjustment device according to claim 1, further comprising a return spring connected to the setting member, the return spring serving to move the throttle valve via the setting member into the idling position ($LL_{min}$) upon activation of the electromagnet.

3. A load adjustment device according to claim 1, wherein the setting member is displaceable between a minimum idle stop ($LL_{min}$) and a maximum idle stop ($LL_{max}$).

4. A load adjustment device according to claim 1, wherein the magnet part is a permanent magnet.

* * * * *